United States Patent [19]

Slomp et al.

[11] 4,069,646

[45] Jan. 24, 1978

[54] DEVICE FOR GUIDING SEAMS OF BAGS

[75] Inventors: Jan Slomp; Marius Grisnich, both of Emmeloord, Netherlands

[73] Assignee: Machinefabriek Grisnich B.V., Emmeloord, Netherlands

[21] Appl. No.: 681,841

[22] Filed: Apr. 30, 1976

[30] Foreign Application Priority Data

Oct. 10, 1975 Netherlands ..... 7511968

[51] Int. Cl.[2] ..... B65B 7/06

[52] U.S. Cl. ..... 53/139; 53/198 A; 53/371

[58] Field of Search ..... 53/138 A, 139, 198 A, 53/371, 373; 112/11

[56] References Cited

U.S. PATENT DOCUMENTS

| | | | |
|---|---|---|---|
| 1,456,836 | 5/1923 | Slezak | 53/371 |
| 2,068,439 | 1/1937 | Staves | 53/387 |
| 2,097,447 | 11/1937 | Cundall et al. | 53/139 X |
| 2,134,567 | 10/1938 | Long et al. | 53/371 |
| 2,381,716 | 8/1945 | Booth | 53/371 X |
| 2,817,936 | 12/1957 | Peterson | 53/139 |
| 2,877,615 | 3/1959 | Foster | 53/371 |
| 3,058,272 | 10/1962 | Hubber | 53/139 X |
| 3,163,969 | 1/1965 | Irwin et al. | 53/138 A |
| 3,218,961 | 11/1965 | Kraft et al. | 53/373 X |
| 3,338,192 | 8/1967 | King | 53/139 X |

FOREIGN PATENT DOCUMENTS

| | | | |
|---|---|---|---|
| 646,895 | 11/1962 | Italy | 53/371 |

*Primary Examiner*—Harrison L. Hinson
*Assistant Examiner*—John Sipos
*Attorney, Agent, or Firm*—Snyder, Brown & Ramik

[57] ABSTRACT

In order to reduce manual operation in filling and closing bags a device for guiding and interconnecting slack seams of filled bags along a locking apparatus is provided, which is characterized by at least one horizontal sequence of driven conveying members engaging at least one bag seam, the seam-contacting faces of which being movable in an inclined position upwards towards the locking apparatus.

9 Claims, 12 Drawing Figures

Figure 5:
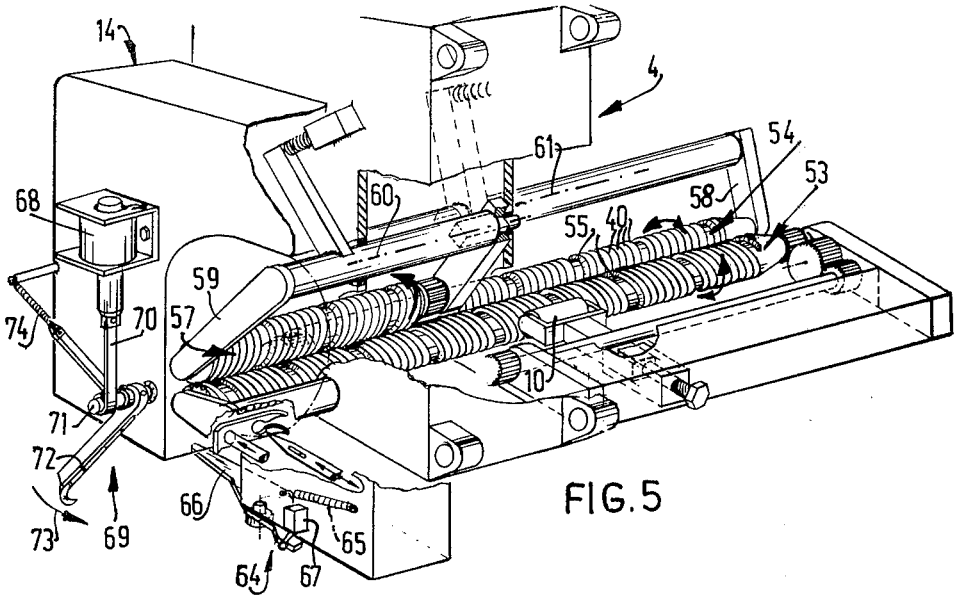

FIG.1
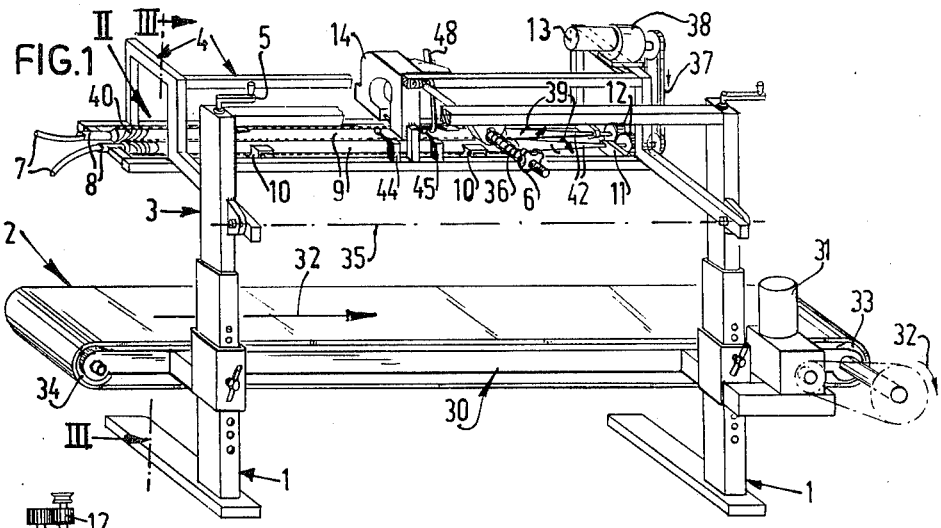
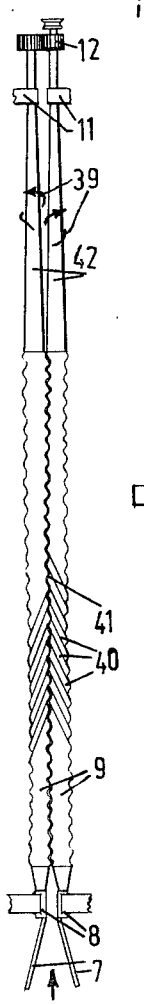
FIG.2
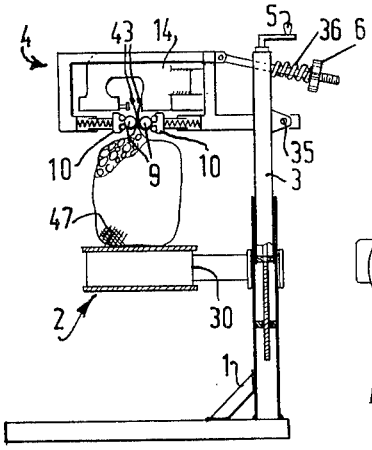
FIG.3
FIG.4
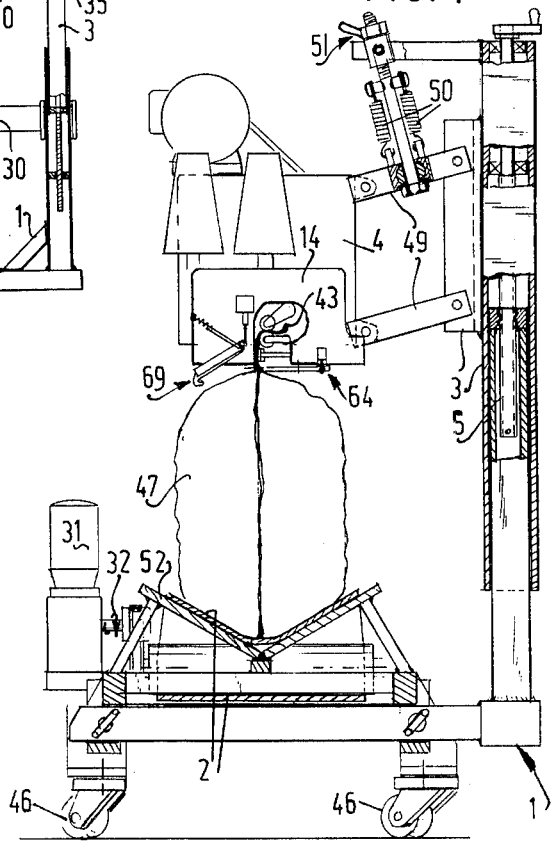

DEVICE FOR GUIDING SEAMS OF BAGS

The invention relates to a device for guiding and interconnecting slack seams of filled bags along a locking apparatus.

Bags of slack tissue, for example, jute or a synthetic resin, filled with potatoes or other agricultural or horticultural produce can be closed only with difficulty. It is known to sew up such bags by means of a suspended sewing machine, the seams of the bag being constantly guided manually along the needle(s).

The invention has for its object to reduce manual operation in filling and closing bags. The device according to the invention is characterised by at least one horizontal sequence of driven conveying members engaging at least one bag seam, the seam-connecting faces of which being movable in an inclined position upwards the locking apparatus. Thus the bag seams are constantly elevated further until the locking apparatus can automatically close the bag seams so that one operator can be saved.

The device is preferably characterised by two horizontal sequences of driven conveying members each engaging a bag seam and picking up the two seams in between them, which improves the grip on both bag seams.

When the device comprises means for bending the bag seams around a first worm roller, the bag can be readily sewn up beneath said first worm roller by means of a conventional sewing machine.

The aforesaid and further features of the invention will be described more fully hereinafter with reference to a drawing.

Figure 6:
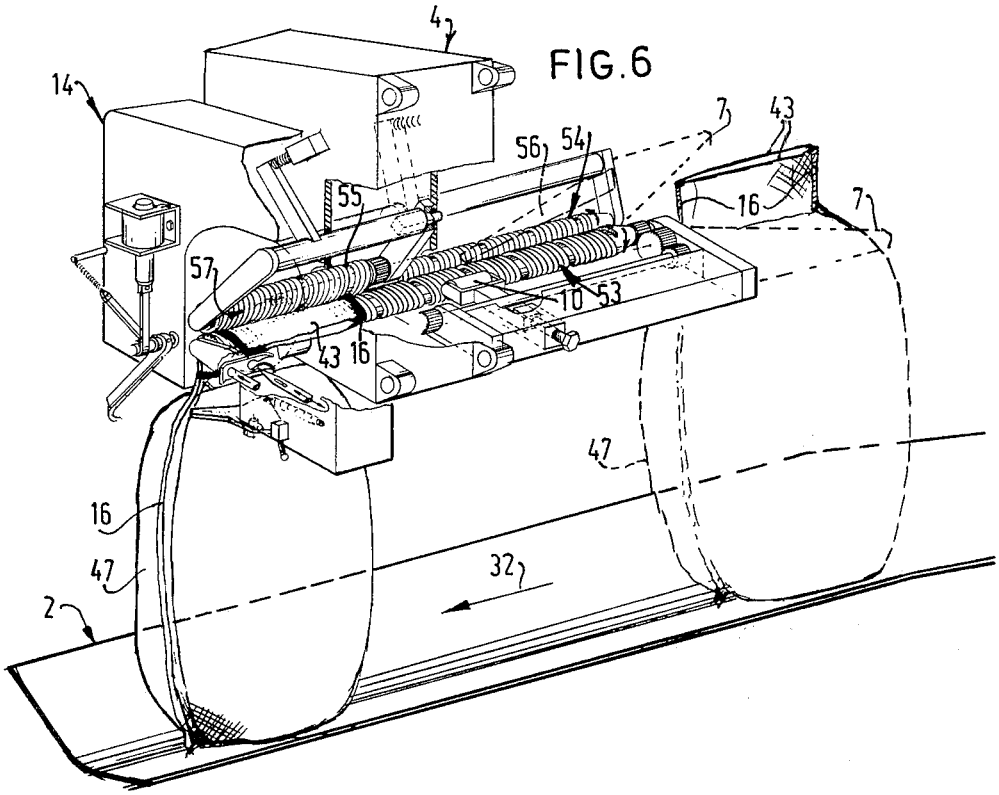
Figure 7:
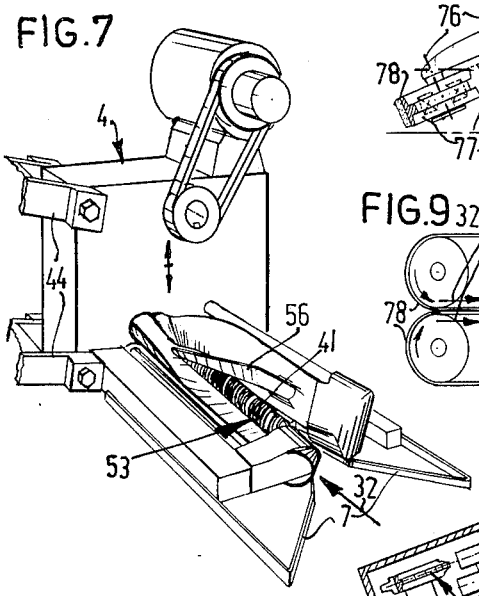
Figure 8:
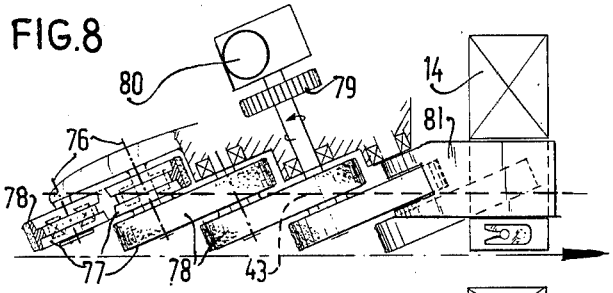
Figure 9:
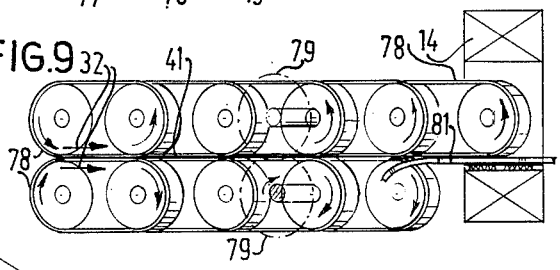
Figure 10:
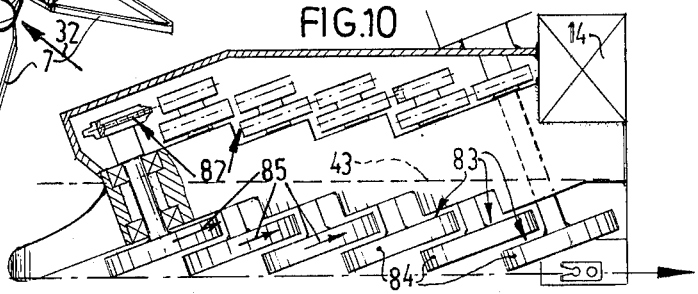
Figure 12:
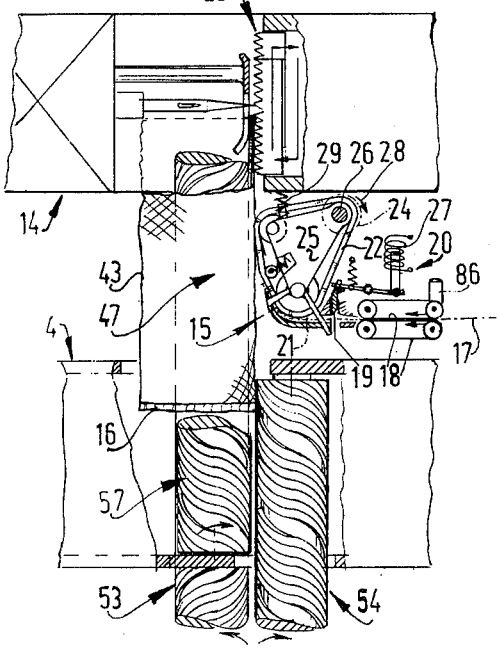
Figure 11:
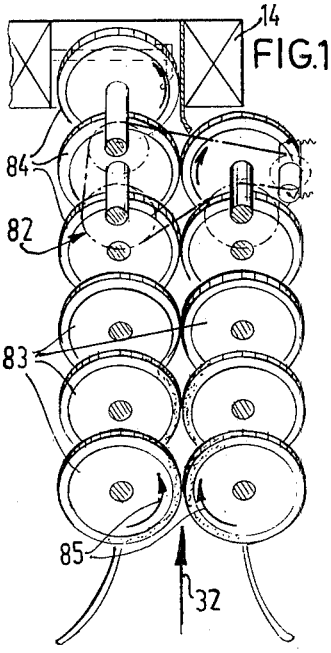

In the drawing show:

FIG. 1 a perspective view of a device embodying the invention,

FIG. 2 an enlarged plan view of a detail II in FIG. 1,

FIG. 3 an elevational view in the direction of the arrows III in FIG. 1,

FIG. 4 a partial sectional view of a preferred embodiment of a device in accordance with the invention, FIGS. 5 and 6 perspective views of part of the device shown in FIG. 4 with and without filled bags respectively, FIG. 7 a perspective view of the feeding end of the device shown in FIG. 4, FIGS. 8 and 10 each a schematic side elevation and FIG. 9 and FIG. 11 each a plan view of part of further variants of the device in accordance with the invention and FIG. 12 a plan view partly broken away of the device shown in FIG. 4.

A substructure 1 supports a level-adjustable conveyor frame 30 having a motor 31 for driving an endless conveyor belt 2 in the direction of the arrow 32, passed around a driving roller 33 and a reversing roller 34. A frame 3 is arranged on the substructure 1 so as to be adjustable in height by means of screw-jacks 5. An auxiliary frame 4 is adapted to turn about an axis 35 and suspended to the frame 3 so as to be variable in height. The auxiliary frame 4 is supported by the frame 3 through spring means 36 biassed by means of a handwheel 6. In the auxiliary frame 4 two worm rollers 9 are rotatably journalled in bearings 8 and 11. A motor 13 drives the worm rollers 9 in opposite directions 39 through a delay driving gear 38 and a rope driving gear 37 and gear wheels 12. The distance between the centres of the worm rollers 9 as well as that of the bearings 8 and 11 and of the pressure rollers 10 are adjustable. Thus the gap width between the worm rollers 9 is adjustable. The worm rollers have shallow, rounded-off helical grooves 40 having a large pitch. One of the two worm rollers 9 has right-hand helical grooves and the other left-hand grooves 40, whilst the directions of rotation 39 are opposite one another in an upward sense in the nip 41. At their ends the worm rollers 9 have a tapering shaft 42. The thin worm rollers 9 are supported by rollers 10 capable of absorbing a force from the nip 41. These rollers 10 are arranged in front of and, as the case may be, also after the sewing machine 14 arranged above the worm rollers 9 so that the seams 43 of the bag to be closed pass across the sewing machine 14. The actuation and deactuation of the sewing machine 14 are governed by a first feeler 44 responding to the arrival of the filled bag 47 and a second feeler 45 responding to the passage of a sewn-up bag, said feelers being arranged beneath or above the worm rollers 9. A cutter 48 is controlled by the second feeler 45 so that each thread of the stitch between the closed bag 47 and the sewing machine 14 is cut off. The worm rollers 9 are joining converging feeding strips 7.

The preferred embodiment of the device shown in FIGS. 4 to 7 comprises a substructure 1 movable on wheels 46, a frame 3 on the substructure 1 so as to be adjustable in height by screwjacks 5 and an auxiliary frame 4, which is supported by means of parallel arms 49 and tensile springs 50 adjustable biassed by means of screw-jacks 51 by the frame 3.

Beneath the auxiliary frame 4 the substructure 1 supports an endless conveyor belt 2 driven by a motor 31 in the direction of the arrow 32 and having a supporting surface 52 of hollow profile for carrying the filled bags 47. Owing to the hollow profile the bags 47 will sag out to a lesser extent so that the bag seams 43 are better held in a straight state and can thus be sewn more readily. The auxiliary frame 4 holds the locking apparatus formed by the sewing machine 14. The device for guiding the slack seams 43 to be interconnected of the filled bag 47 along the sewing machine 14 comprises two horizontal sequences of driven conveying members each engaging a bag seam 43, said sequences receiving between them the two seams 43, said conveying members being formed by helical grooves 40 of horizontal rotatably driven worm rollers, that is to say, a long, first worm roller 53 and a shorter, second worm roller 54. At least one, but preferably both worm rollers 53 and 54 has a helical cavity 55 for a bag seam 16 between two consecutive helical grooves 40. This facilitates the introduction of the bag 47 into the nip 41 between the worm rollers 53 and 54. Thereto contribute furthermore the converging feeding strips 7.

In order to enable sewing up the bag seams 43 below the first worm roller 53 by means of a conventional sewing machine 14 means are provided for bending the bag seams 43 around the first worm rollers 53 (see FIG. 6), said means comprising a guide rod 56 extending obliquely to the direction of movement 32 of the bag seams 43 above the second worm roller 54. The bending means comprise furthermore a third worm roller 57 arranged above the first worm roller 53 and driven in a sense opposite that of the first worm roller 53. The directions of rotation and the directions of the helices of the worm rollers 54 and 57 are opposite those of the worm roller 53 so that the worm rollers 54 and 57 exert an upward tractive force on the bag seams 43 because the helical grooves 40 forming conveying members have contact surfaces engaging the bag seams 43 moving obliquely upwards in the direction 32 towards the sewing machine 14. The sewing machine 14 consists of a frame with laterally spaced leg portions joined at their upper ends to define an archway, one leg presenting a vertical surface and the other leg carrying a pressure foot which presses the bag mouth flatwise against said vertical surface. Said pressure foot is located below the roller 53 as shown in FIGS. 4-6.

An adjustable pressure roller 10 supports the long, first worm roller 53. The worm rollers 54 and 57 are rotatably journalled in supports 58 and 59 respectively, adapted to pivot about axes 60 and 61 respectively in the auxiliary frame 4 and being urged by springs 62 and 63 respectively towards the worm roller 53.

A feeler 64 formed by a pivotal arm 66 loaded by a spring 65 actuates a switch 67 for switching on the sewing machine 14, when the bag 47 arrives and it also actuates said switch 67, when the bag 47 has passed and the spring 65 retracts the pivotal arm 66. When the sewing machine 14 is switched off, an electro-magnet 68 of a cutting member 69 is energized, said member being coupled through a flexible pulling member 70 with a pivotal shaft 71 of a knife 72, which swings upwardly in the direction of the arrow 73 and severs the two threads between the sewing machine 14 and the sewn-up bag 47. Through a flexible pulling member 75 a tensile spring 74 draws back the knife 72, when the electro-magnet 68 is de-energized.

The conveying speed of the worm rollers 53, 54 and 57 in the direction 32 is approximately equal to that of the conveyor belt 2.

In the device according to the invention shown in FIGS. 8 and 9 the sequences of conveying members engaging the bag seams 43 comprise each - instead of the helical grooves 40 of worm rollers 53 and 54 — rollers 77 adapted to rotate about backwardly inclined axes 76 and V-ropes 78 guided around the same, engaing the bag seams 43 and subsequently moving obliquely upwards. The V-ropes 78 are endless driving means driving the rollers 77 in the correct sense and coupling them with one another. The rollers 77 located one on each side of the nip 41 are intercoupled through two gear wheels 79 driven by a motor 80. The sewing machine 14 comprises a V-rope 78 only on one side of the nip 41, co-operating with a stationary guide plate 81.

In the device according to the invention illustrated in FIGS. 10 and 11 two sequences of rollers 83 driven by means of chain drives 82 engage the bag seams 43, for example, by soft tyres 84 and carry the bag seams 43 obliquely upwards in the direction of the arrow 85, whilst clamping the seams 43 in between them. Viewed in the direction towards the sewing machine 14, the transmission ratio of the chain drives 82 slightly exceeds unity so that the bag seams 43 are slightly stretched and thus sewn together along a correctly straight line.

Each device according to the invention may be provided with a cad feeder 15. FIG. 12 shows a card feeder 15 arranged between the sewing machine 14 and the worm roller 54. A strip 17, a card 21 being each time cut therefrom by means of a knife 19 and a cutter 20, is fed by endless belts 18. The card 21 is brought into contact by an endless belt 22 with a bag 47 and is then engaged by the transport mechanism 23 of the sewing machine 14 to be stitched to the bag seams 43. The endless belt is driven by a motor 24 and is journalled in a frame 25, which is capable of turning about the driving shaft 26. The switch 67 of the sewing machine 14 also starts the motor 24. The driving torque of the motor 24 turns the frame 25 in the direction of the arrow 28 towards the bag 47. A time relay (not shown) switches off the motor 24, after which a spring 29 urges the frame 25 back. Said time relay switches on a motor 86 of the belts 18 as well as a time relay (not shown) switching off the motor 86 and enabling the energization of an electro-magnet 27 of the knife 19 so that a card 21 is fed into the frame 25 and subsequently severed from the strip 17.

What we claim is:

1. A machine for sewing closed the open mouth of a bag by means of a conventional bag sewing machine having a frame presenting laterally spaced leg portions joined at their upper ends to define an archway through which the mouth of a bag is passed during the sewing operation, one leg presenting a vertical surface and the other leg carrying a pressure foot which presses the bag mouth flatwise against said vertical surface, the improvement which comprises:

a frame and conveying means on said frame for travelling a bag along a given path;

a subframe mounted on said frame above said conveying means, said sewing machine being mounted on said subframe to allow the open mouth of a bag to pass through said archway as the bag is moved by said conveying means;

a first worm roller rotatably mounted on said subframe and extending horizontally from a point spaced from said sewing machine in the upstream direction of the travel of said conveying means and extending therefrom into said archway above said pressure foot and closely adjacent said vertical surface;

a second worm roller rotatably mounted on said subframe and extending horizontally into said archway closely adjacent said vertical surface and in substantially vertical registry with and above said first roller to define a nip therewith which lies in a substantially horizontal plane;

means for driving said rollers in opposite directions to feed a bag mouth in the direction of bag travel while pulling the bag mouth over said first roller in said substantially horizontal plane with the bag mouth portion immediately below said first roller substantially flatwise against said vertical surface and between it and said pressure foot;

said second roller commencing at a point closer to said sewing machine than said point at which said first roller commences whereby an upstream end portion of said first roller projects beyond said second roller.

2. The machine as defined in claim 1 including means cooperating with said upstream end portion of the first roller for guiding a bag mouth to said nip.

3. A machine as defined in claim 2 wherein the means last mentioned includes a third worm roller rotatably mounted on said subframe in horizontally registered relation to said upstream end portion of the first roller to define a nip therewith which lies in a substantially vertical plane essentially coplanar with said vertical surface, and said means for driving also drives said third roller in the same direction as said second roller.

4. A machine as defined in claim 1 including means for inserting a label between said bag mouth portion immediately below said first roller and said vertical surface.

5. A machine as defined in claim 3 wherein at least one of said first and third rollers is provided, within the confines of the nip formed between such rollers, with a helical cavity for a bag seam.

6. A machine as defined in claim 1 including means for yieldably urging said rollers together.

7. A machine as defined in claim 1 wherein said subframe is vertically adjustable with respect to said conveying means.

8. A machine as defined in claim 1 wherein said conveying means is of channel-shaped profile in order to orient bags in a generally upstanding position.

9. A machine as defined in claim 3 including means for swingably mounting each said second and said third roller for movement toward and away from said first roller and including means for yieldably urging each said second and third roller toward said first roller.

* * * * *